US011712775B2

(12) United States Patent
Tucker

(10) Patent No.: US 11,712,775 B2
(45) Date of Patent: Aug. 1, 2023

(54) MACHINE TOOLS AND METHODS OF OPERATION THEREOF

(71) Applicant: Fives Landis Limited, Keighley (GB)

(72) Inventor: Matthew Tucker, Bedford (GB)

(73) Assignee: Fives Landis Limited, Keighley (GB)

( * ) Notice: Subject to any disclaimer, the term of this patent is extended or adjusted under 35 U.S.C. 154(b) by 1056 days.

(21) Appl. No.: 16/477,097

(22) PCT Filed: Jan. 22, 2018

(86) PCT No.: PCT/GB2018/050184
§ 371 (c)(1),
(2) Date: Jul. 10, 2019

(87) PCT Pub. No.: WO2018/138481
PCT Pub. Date: Aug. 2, 2018

(65) Prior Publication Data

US 2019/0351523 A1 Nov. 21, 2019

(30) Foreign Application Priority Data

Jan. 25, 2017 (GB) ..... 1701246

(51) Int. Cl.
*B24B 19/22* (2006.01)
*B24B 19/00* (2006.01)
(Continued)

(52) U.S. Cl.
CPC ..... *B24B 19/226* (2013.01); *B24B 19/009* (2013.01); *B24B 41/005* (2013.01);
(Continued)

(58) Field of Classification Search
CPC .. B24B 7/04; B24B 7/16; B24B 7/224; B24B 7/24; B24B 13/0018; B24B 19/226;
(Continued)

(56) References Cited

U.S. PATENT DOCUMENTS 2,309,016 A 1/1943 Ryan
4,461,121 A 7/1984 Motzer et al.
(Continued)

FOREIGN PATENT DOCUMENTS

CN 202825575 U 3/2013
EP 0239918 A2 10/1987
(Continued)

OTHER PUBLICATIONS

English language abstract of French Patent Publication No. FR 2535640 Al, European Patent Office, May 11, 1984.
(Continued)

*Primary Examiner* — Lee D Wilson
*Assistant Examiner* — Robert F Neibaur
(74) *Attorney, Agent, or Firm* — Kolitch Romano Dascenzo Gates LLC

(57) ABSTRACT

A machine tool comprises first and second support arms, and a rigid structure which couples the first support arm to the second support arm. A first rotary drive is operable to rotate the first support arm and the rigid structure relative to each other about a first rotational reference axis, and a second rotary drive is operable to rotate the second support arm and the rigid structure relative to each other about a second rotational reference axis, wherein the first and second rotational reference axes are parallel and spaced apart by a fixed distance. A control arrangement is configured to control the first and second rotary drives such that a workpiece mount carried by the second support arm follows a predetermined path relative to a tool mount carried by the first support arm in a plane perpendicular to the rotational reference axes.

23 Claims, 11 Drawing Sheets

(51) Int. Cl.

| | |
|---|---|
| ***B24B 41/00*** | (2006.01) |
| ***B24B 41/04*** | (2006.01) |
| ***B24B 41/06*** | (2012.01) |
| ***B24D 7/18*** | (2006.01) |

(52) U.S. Cl.
CPC ..... *B24B 41/04* (2013.01); *B24B 41/067* (2013.01); *B24D 7/18* (2013.01)

(58) Field of Classification Search
CPC ..... B24B 19/009; B24B 41/005; B24B 41/04; B24B 41/067; B24B 47/12; B24D 7/18; B24D 7/10; B24D 7/14; B23Q 3/52–527
See application file for complete search history.

(56) References Cited

U.S. PATENT DOCUMENTS

| | | | | |
|---|---|---|---|---|
| 4,587,768 | A * | 5/1986 | Doyle | B24B 19/226 451/24 |
| 4,831,784 | A | 5/1989 | Takahashi | |
| 4,979,334 | A | 12/1990 | Takahashi | |
| 5,007,209 | A * | 4/1991 | Saito | B24B 19/226 451/41 |
| 5,038,524 | A * | 8/1991 | Moulin | B24B 19/226 451/550 |
| 5,231,587 | A | 7/1993 | Frost | |
| 5,351,327 | A | 9/1994 | Lurie et al. | |
| 6,099,238 | A * | 8/2000 | Tsubota | B25J 9/107 901/29 |
| 6,755,719 | B2 * | 6/2004 | Yoshida | B24B 49/16 451/6 |
| 6,814,651 | B2 * | 11/2004 | Enomoto | B24B 49/16 451/63 |
| 6,951,508 | B1 * | 10/2005 | Brubacher | B24B 49/003 451/64 |
| 8,376,685 | B2 * | 2/2013 | Pietrantonio | H01L 21/68707 414/744.5 |
| 8,771,042 | B2 | 7/2014 | Pepin et al. | |
| 10,518,337 | B2 * | 12/2019 | Kschier | B25J 9/0084 |
| 2003/0190875 | A1 * | 10/2003 | Grabbe | B24B 19/226 451/65 |
| 2011/0288677 | A1 | 11/2011 | Meidar et al. | |

FOREIGN PATENT DOCUMENTS

| | | | |
|---|---|---|---|
| EP | 0706853 | A | 4/1996 |
| EP | 0937543 | A2 | 8/1999 |
| FR | 2535640 | A1 | 5/1984 |
| GB | 2476468 | A | 6/2011 |
| GB | 2481632 | A | 1/2012 |
| GB | 2491020 | A | 11/2012 |
| JP | 2000137144 | A | 5/2000 |
| JP | 2008055593 | A | 3/2008 |
| JP | 2008238389 | A | 10/2008 |
| JP | 2015077648 | A | 4/2015 |
| WO | WO 2011/077127 | A2 | 6/2011 |
| WO | WO 2015/192784 | A1 | 12/2015 |

OTHER PUBLICATIONS

English language abstract of Japanese Patent Publication No. JP 2000137144 A, European Patent Office, May 16, 2000.

English language abstract of Japanese Patent Publication No. JP 2008055593 A, European Patent Office, Mar. 13, 2008.

English language abstract of Japanese Patent Publication No. JP 2008238389 A, European Patent Office, Oct. 9, 2008.

English language abstract of Chinese Utility Model Publication No. CN 202825575 U, European Patent Office, Mar. 27, 2013.

English language abstract of Japanese Patent Publication No. JP 2015077648 A, European Patent Office, Apr. 23, 2015.

English language abstract of PCT Patent Application Publication No. WO 2015/192784 Al, European Patent Office, Dec. 23, 2015.

Search Report issued in connection with United Kingdom Patent Application No. GB 1701246.9, 1 page, United Kingdom Intellectual Property Office, dated May 26, 2017.

Search Report issued in connection with United Kingdom Patent Application No. GB 1701246.9, 2 pages, United Kingdom Intellectual Property Office, dated Sep. 21, 2017.

Search Report issued in connection with United Kingdom Patent Application No. GB 1800990.2, 1 page, United Kingdom Intellectual Property Office, dated Jul. 4, 2018.

* cited by examiner

MACHINE TOOLS AND METHODS OF OPERATION THEREOF

FIELD OF THE INVENTION

The present invention relates to machine tools and more particularly to reduction of alignment errors in such tools. It also concerns grinding wheels for use in machine tools.

BACKGROUND TO THE INVENTION

Machine tools for precisely forming desired profiles on workpieces need to have high stiffness, accuracy and be capable of reliably repeatable operation.

One application at which the machine tool of the present invention is directed is the formation of end surfaces on ferrule connectors for optical fibres. A known ferrule connector configuration is shown in FIG. 1.

The ferrule connector 2 of FIG. 1 includes a cylindrical alignment member 4 coupled to a flange 6 of a connector body 8. An optical fibre cable 10 is received in one end of the body 8 opposite to the alignment member 4. The alignment member 4 has a central bore 12 which receives a single optical fibre 14.

The distal end of the alignment member 4 has a chamfered portion 16 and a convex spherical surface 18. The spherical surface 18 is angled so that its centre of curvature 19 is laterally displaced from the central axis 32 of the alignment member. The end face of the ferrule is angled and spherical to minimise reflections of the light at the fibre end and to combat insertion loss due to separation of the ends of the two fibres being connected together. The alignment member may be made of a ceramic material or stainless steel for example.

Known processes for shaping the end of a ferrule involve grinding a spherical angled face on a blank ferrule, inserting and bonding a fibre in the central bore of the ferrule, and then polishing the end of the combined ferrule and fibre.

U.S. Pat. Nos. 4,831,784 and 4,979,334 describe polishing apparatus for forming a spherical surface on the end of a ferrule connector using a compliant polishing pad.

SUMMARY OF THE INVENTION

The present invention provides a machine tool comprising:

first and second support arms;

a rigid structure which couples the first support arm to the second support arm;

a first rotary drive operable to rotate the first support arm and the rigid structure relative to each other about a first rotational reference axis;

a second rotary drive operable to rotate the second support arm and the rigid structure relative to each other about a second rotational reference axis, wherein the first and second rotational reference axes are parallel and spaced apart by a fixed distance;

a tool mount carried by the first support arm at a location spaced from the first rotational axis, wherein the tool mount is rotatable relative to the first support arm about a tool reference axis which is parallel with the rotational reference axes and fixed in position relative to the first support arm;

a tool drive for rotating the tool mount about the tool reference axis;

a workpiece mount carried by the second support arm at a location spaced from the second rotational axis; and a control arrangement configured to control the first and second rotary drives such that the workpiece mount follows a predetermined path relative to the tool mount in a plane perpendicular to the rotational reference axes.

The inventor has determined that, with such a machine tool, a workpiece may be precisely moved relative to a tool rotating about an axis parallel to the axes of two rotary drives, with the relative motion generated using the two rotary drives. The workpiece is offset from one rotary axis by the second support arm and the tool is offset from the first rotational reference axis by the first support arm. As the first and second rotational reference axes are spaced apart by a fixed distance, and the tool mount is fixed in position relative to the first support arm, their relative positions can be known with a high degree of accuracy and reliability, thereby increasing the precision with which the positions of the tool mount and workpiece mount relative to each other can be controlled. This configuration also means that the machine can be designed to exhibit a high stiffness, by avoiding the compliance that would otherwise be associated with traditional machine configurations that use stacked linear slides.

The precision of the machine (in combination with high machining loop stiffness) may mean that sub-surface damage during a grinding process is reduced to the extent that a polishing step is either minimal or not required at all.

The machine tool may be suitable for machining axisymmetric profiled features onto workpieces, with the shaping of ferrule connectors being one example of a suitable application.

References herein to one component being fixed in position relative to another preferably mean fixed in the sense of being unadjustably fixed in position, as opposed to being locked in a selected position which can be changed when an adjustment mechanism is unlocked.

In a preferred example, the control arrangement is configured to control the first and second rotary drives such that the workpiece mount follows a circular path relative to the first support arm in a plane perpendicular to the rotational reference axes. The inventor realised that it is possible to achieve such relative movement using only two support arms mounted on respective rotary drives. This circular motion is particularly suitable for ferrule end grinding as will be described further below.

In one implementation, one of the support arms is fixed in position (preferably unadjustably fixed rather than being adjustable and locked in a selected position) relative to the supporting base of the machine tool (and may itself be provided by the machine base). The rotary drive associated with that support is operable to rotate the rigid structure relative to that support arm and the machine base.

In an alternative implementation, the rigid structure is fixed in position (again preferably unadjustably fixed) relative to a supporting base of the machine tool (and may itself be provided by the machine base). In this configuration, each rotary drive is operable to rotate the respective support arm relative to the rigid structure and therefore the supporting base of the machine tool.

In a further preferred example, the first and second drives are the only drives of the machine tool which are operable to move the tool mount and the workpiece mount relative to each other in a plane perpendicular to the first and second rotational reference axes. By only using two machine drives a fixed distance apart, it is then possible to accurately calibrate the machine so that the tool mount and workpiece mount can be positioned with a high degree of accuracy. In contrast, in machine tools employing multiple inter-dependent driven axes of motion, the errors associated with each separate motion are cumulative and so it may be more difficult to accurately predict the tool and/or workpiece mount positions. The reference to the "only drives" here is in the sense of being the only drives operable in the manner defined when all drives of the machine are free to move, rather than when some drives are selectively locked.

The workpiece mount may be arranged to hold a workpiece in a fixed position rotationally with respect to the second support arm during machining of the workpiece carried by the workpiece mount. That is, there may be no workpiece rotation relative to the second support arm during machining of the workpiece. In some circumstances, the workpiece may be rotated to facilitate material removal, but a desired profile may be preferably machined (by grinding or polishing for example) onto the workpiece without any workpiece rotation relative to the second support arm.

Preferably, at least one of the tool mount and the workpiece mount is moveable relative to the rigid structure in a direction parallel to the first and second rotational reference axes. In this way, tool wear can be accommodated over time by slightly advancing the workpiece mount towards the tool mount, or vice versa. Also, in some cases it may be necessary to move the workpiece and tool mounts further apart whilst they are moved into position for the start of a machining process before they are then moved together. For example, in embodiments discussed below, the workpiece may need to pass over an outer portion of a grinding wheel before being moved in an axial direction to engage a groove on the grinding wheel.

For example, a drive may be provided to move one or both of the tool mount and the workpiece mount relative to the respective support arm, or one or both of the support arms may be drivable relative to the rigid structure in a direction parallel to the first and second rotational reference axes.

The second support arm may form part of a workpiece support which carries a plurality of workpiece mounts, each of which is spaced from the second rotational axis. This may enable multiple workpieces to be machined consecutively by loading them into the machine in a single initial set up procedure, thereby increasing the throughput of the machine.

The tool mount may be arranged to carry a grinding wheel with its central axis coaxial with the tool reference axis. The tool mount may include a rotary drive or spindle for rotating a tool mount thereon relative to the first support arm about the tool reference axis.

In some examples, the workpiece mount may be adapted to carry a fibre optic ferrule. It has been found that using machine tools embodying the invention, end features can be ground onto a combined ferrule and bonded fibre without causing any significant loss in optical transmission, which would normally be expected when grinding using conventional grinding machines. Known grinding processes tend to be too aggressive for the brittle material of the optical fibre, resulting in sub-surface damage.

Conventional glass grinding processes generally involve "brittle fracture", in which the grinding abrasive microscopically shatters the surface of the workpiece to remove stock material. The removal of material leaves the surface covered in micro-cracks. Known glass grinding machines have poor machining loop stiffness and may be unable to accurately control the cut depth. Machine tools described here may be able to provide a highly accurate machining path which allows precise control of diamond edges in a conditioned grinding wheel. It may therefore be possible to promote ductile regime grinding where crack propagation at the material surface is substantially lower than that of brittle mode glass grinding, potentially around ten times lower. The process may therefore be substantially less aggressive in comparison known glass grinding processes.

A tool may be mounted on the tool mount which includes a surface in a plane perpendicular to the rotational reference axes which, in use of the machine tool, is brought into engagement with a workpiece held in the workpiece mount. The machine tool may then be able to move the workpiece along a predetermined path, relative to the tool mount and on this surface of the tool, in order to carry out a desired process on the workpiece. For example, the surface in the plane perpendicular to the rotational reference axes may be a grinding surface or a polishing surface. The surface may be rigid or compliant.

In preferred implementations, moving a workpiece over the surface of the tool in this manner enables formation of the desired profile on the workpiece (which may be an axisymmetric profile) without needing to rotate the workpiece mount relative to the second support arm. An axisymmetric profile may be formed by moving the workpiece along a circular path on the surface of the tool.

The present invention further provides a grinding wheel which may, for example, be suitable for grinding a fibre optic ferrule. The wheel comprises a wheel body having a central rotational axis about which the wheel is rotated in use, and a transverse side surface, wherein the transverse side surface includes at least one circular groove for grinding a workpiece, the groove having a central axis (perpendicular to the plane of the groove) which is coaxial with the central rotational axis of the wheel. The groove may be shaped so as to impart a desired profile on a workpiece ground by the grinding wheel. A workpiece may be moved by a machine tool around the circle defined by the groove as the grinding wheel rotates. This may machine an axisymmetric profile onto the workpiece. The desired profile may be achieved by moving the workpiece around the groove, without rotating the workpiece relative to its support.

In preferred examples, the transverse side surface of the wheel includes at least two concentric circular grooves. In some configurations, two of the grooves have different abrasive properties. The abrasive properties of the grooves may be selected from roughing, semi-finishing and polishing, for example.

Provision of two or more grooves, with each having different abrasive properties, may enable processing of a workpiece such as an optical fibre ferrule from grinding through to polishing whilst needing to carry out only a single workpiece set up procedure.

In some configurations, a groove with a larger diameter may be more abrasive than another groove with a smaller diameter. A groove with a large diameter will be longer and so as a result the grit in the longer groove will wear more slowly.

Accordingly, it may therefore be preferable to use coarser materials in the larger groove as it may see heavier usage. One or more grooves may be impregnated with polishing compound, to enable polishing as part of the machining operation.

Two grooves of the same wheel may have different profiles in a cross-sectional plane parallel to and including the central rotational axis of the wheel. This may enable the wheel to impart different profiles to the same or different parts of a workpiece during the same machine operation.

The present invention also provides a method of machining a workpiece using a machine tool as described herein, comprising the steps of:

mounting a workpiece in the workpiece mount;

engaging the workpiece with a tool mounted on the tool mount; and rotating the first support arm and the rigid structure relative to each other about the first rotational reference axis and rotating the second support arm and the rigid structure relative to each other about the second rotational reference axis such that the workpiece follows a predetermined path relative to the tool in a plane perpendicular to the rotational reference axes.

In a preferred method, the workpiece follows a circular path in the rotating step relative to the tool, in a plane perpendicular to the rotational reference axes.

Preferably, the workpiece is fixed in position rotationally with respect to the second support arm during a machining operation. More particularly, the workpiece may be fixed in position rotationally about a longitudinal axis of the workpiece with respect to the second support arm. In a preferred method, the workpiece is held stationary relative to the second support arm during the machining process (such as grinding or polishing). This may be particularly beneficial when the workpiece is at one end of a bulky and/or long component, such as a fibre optic cable. As a result of the avoidance of rotation of the workpiece, no additional material handling difficulties are caused by rotation or added turns of a fibre optic cable coupled to the workpiece mount. Turns added to the cable would need to be relaxed or unwound before the cable is available for any further processing or storage.

In an implementation using a tool with two concentric grooves thereon, the workpiece is engaged in the engaging step with a first groove on the tool which lies on the circular path, and the method includes the further steps of:

disengaging the workpiece from the first groove;

engaging the workpiece with a second groove on the tool which is concentric with the first groove; and rotating the first support arm and the rigid structure relative to each other about the first rotational reference axis and rotating the second support arm and the rigid structure relative to each other about the second rotational reference axis such that the workpiece follows the second groove.

BRIEF DESCRIPTION OF THE DRAWINGS

A known ferrule connector configuration and embodiments of the invention will now be described by way of example and with reference to the accompanying schematic drawings, wherein.

DETAILED DESCRIPTION

Figure 1:
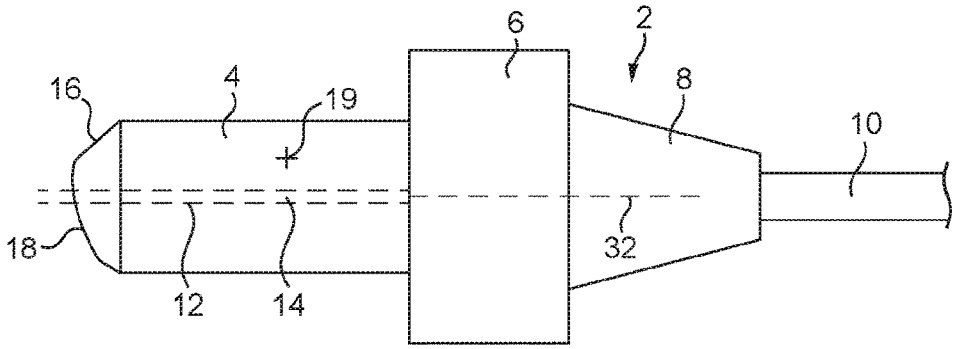
FIG. 1 is a side view of a known ferrule connector configuration.
Figure 2:
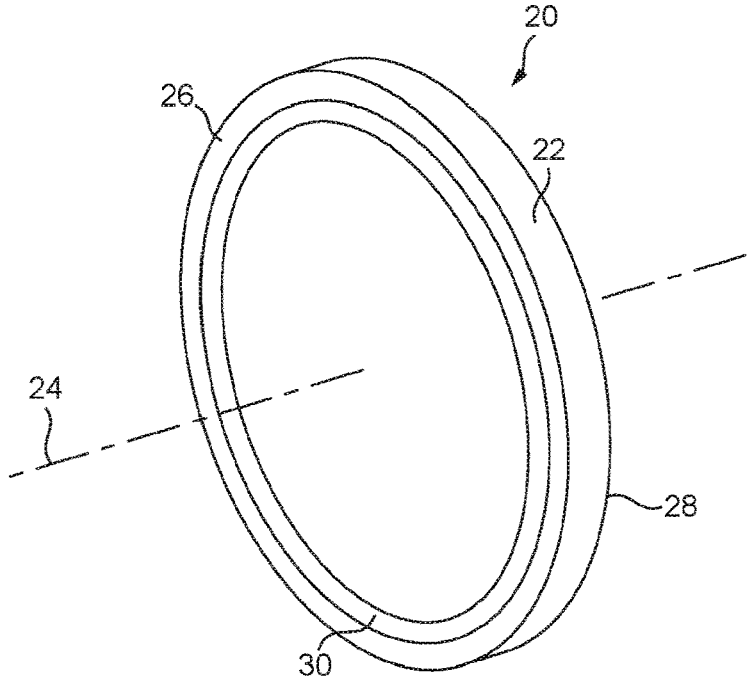
FIG. 2 is a perspective view of a grinding wheel according to an embodiment of the invention.

FIG. 2 shows a perspective view of a grinding wheel 20 according to an embodiment of the present invention. It may be used in a machine tool embodying the invention to grind a fibre optic ferrule, for example. The grinding wheel has a cylindrical peripheral surface 22, coaxial with a central axis 24 of the wheel about which it is rotated in use. The wheel also has a front and rear transverse side faces 26 and 28 which lie in planes perpendicular to the central axis 24.

A circular groove 30 is formed in the front face 26. It is centred on the central axis 24 of the wheel. The groove is a shallow depression in the face of the wheel. The profile of the groove in a plane containing the central axis of the wheel may substantially correspond to part of a circle, or another generally curved or rounded profile, for example. In use of the wheel, a workpiece is brought into engagement with the surface of the groove. The surface may be prepared for grinding or polishing a workpiece as appropriate.

Figure 3:
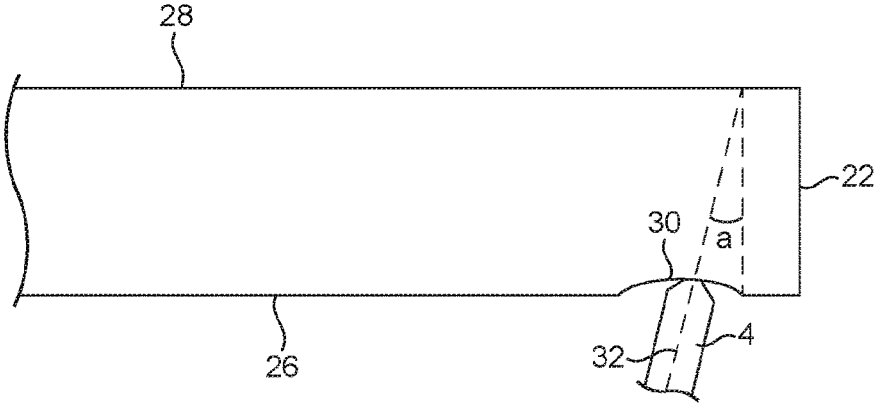
FIG. 3 is a cross-sectional view of parts of a grinding wheel and a ferrule connector in engagement with each other.

FIG. 3 shows an alignment member 4 of a ferrule in contact with groove 30 of a grinding wheel during a grinding operation. As the wheel is rotated to grind the ferrule, the ferrule itself is moved so as to follow the circular shape of the groove around the central axis 24 of the grinding wheel. In this way, a desired shape can be imparted from the groove to the whole of the end surface of the ferrule.

As shown in FIG. 3, the longitudinal axis 32 of the ferrule may be inclined at an angle "a" to the central axis 24 of the grinding wheel in order to incline the profile imparted to the end of the ferrule relative to its longitudinal axis. The angle "a" may be in the range 2 to 20° and is typically about 8°. This angle serves to prevent light reflecting back from the interface with the fibre being connected to from travelling back up the fibre. The same angle is maintained as the ferrule is moved around the circle defined by the groove of the grinding wheel.

Figure 4:
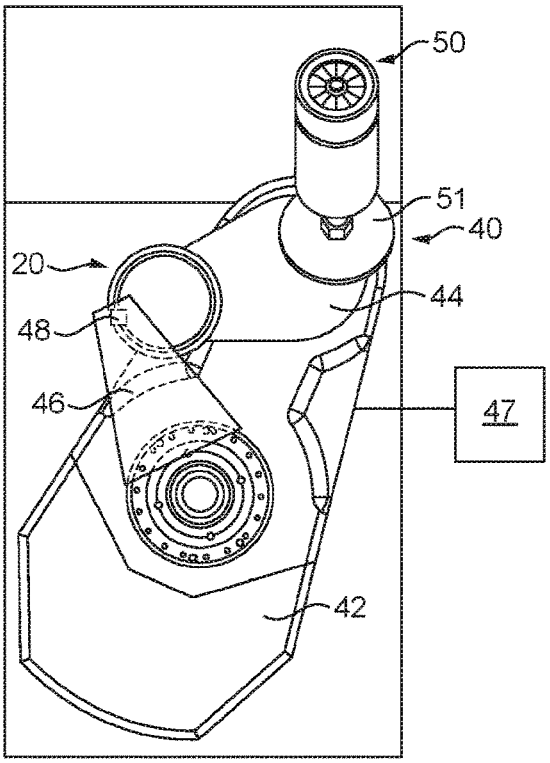
FIG. 4 is a perspective view of a machine tool according to an embodiment of the invention.
Figure 5:
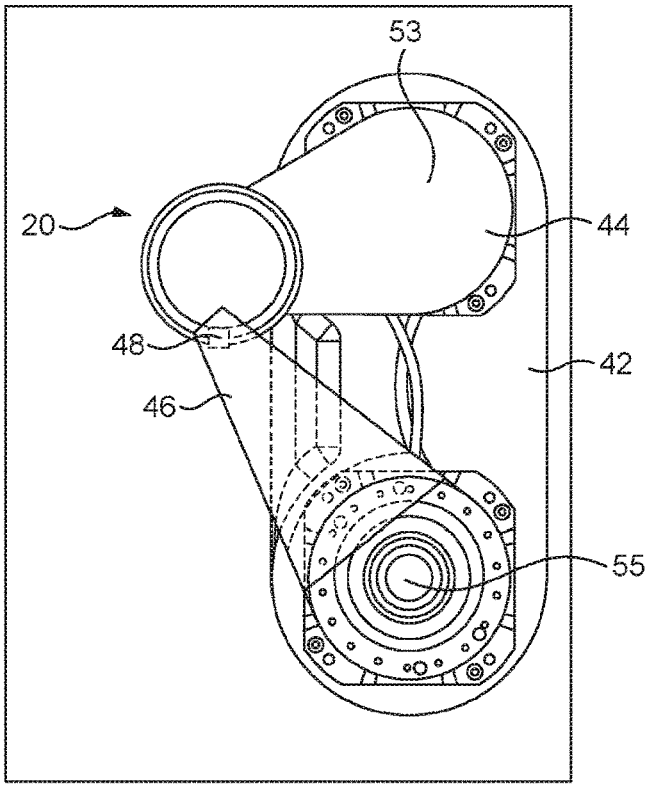
FIGS. 5 to 8 are a plan view, perspective view, side view and rear view of a machine tool embodying the present invention.
Figure 6:
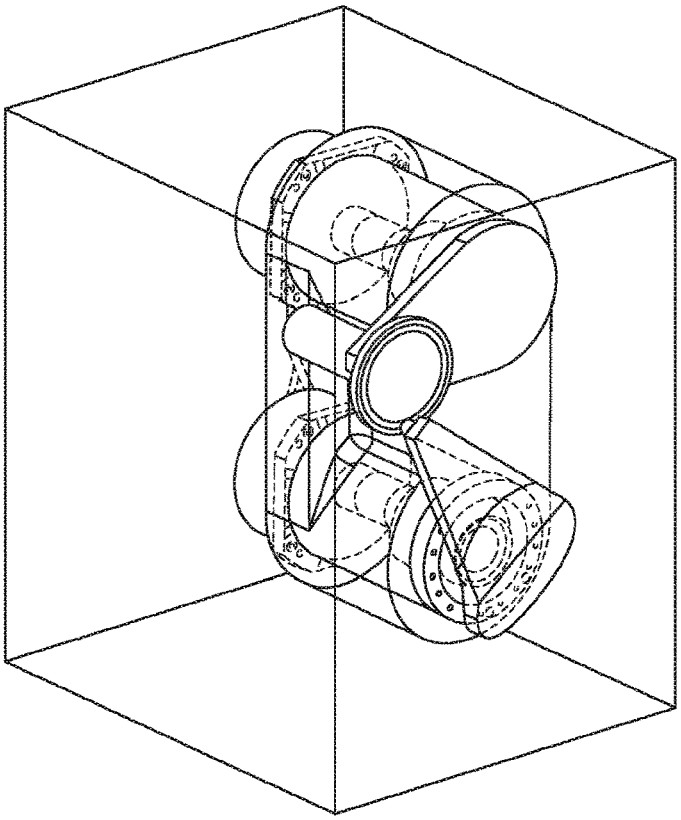

A machine tool 40 embodying the present invention is shown in FIG. 4. It has a machine base 42 on which two support arms 44 and 46 are mounted. The support arms are mounted for rotation relative to the machine base about respective rotational axes 53 and 55 which are parallel to each other. The positions of the support arms are governed by a control arrangement 47 of the machine tool, which may be a CNC system for example.

A grinding wheel 20 is coupled to support arm 44 by a tool mount. The tool mount is coupled to a spindle arranged to rotate the grinding wheel about its central axis. Support arm 44 carries a workpiece mount 48. In FIGS. 4 to 15, support arm 46 is shown as semi-transparent for the purposes of illustration.

A wheel truing, dressing and conditioning spindle 50 is also shown in FIG. 4. This spindle may be supported by the base 42 of the machine. It may be provided to shape or form the grooves in the grinding wheel in order to provide the "negative" or "concave" profile of the wheel for grinding a "positive" or convex profile on the end of the ferrule. The grinding wheel 20 and/or the spindle 50 may be moved relative to the base 42 of the machine tool as and when appropriate to allow the surface of the grinding wheel to be engaged with a tool carried on the spindle 50. The support arm 44 and/or the spindle may be carried by the machine base in a way that enables them to move relative to each other to feed or plunge a tool mounted on the spindle into a surface of a grinding wheel mounted on the support arm.

In FIG. 4, a forming wheel 51 is mounted on the spindle 50. For example, the forming wheel may be disc-shaped and have one or more "positive" circular shapes formed on a face of the disc (that is, on the face opposite to the face visible in FIG. 4) to enable the forming wheel to form the "negative" grinding grooves by plunging the forming wheel into a transverse side face of the grinding wheel. The forming wheel will preferably be very resilient and may include a metal bonded diamond or electroplated diamond abrasive, for example.

The grinding wheel 20 preferably includes a relatively soft bonding material, such as a resin bond material or a light vitreous bond material, and may support a diamond grinding grit. The wheel abrasive is preferably diamond as the workpiece is likely to include glass for the fibre and probably a tough ceramic material for the ferrule.

When using this composition for the grinding surfaces of the grinding wheel, a wheel conditioning or dressing action is preferably carried out to open the wheel (that is, to remove bond material from around the diamond grit) and to cleave sharp, cutting facets onto the diamonds. Spindle 50 may be used in this procedure. The machine tool may be able to interchange wheels on the spindle in an automated manner so that a wheel suitable for this conditioning action is selected and mounted on the spindle.

The machine base 42 provides a rigid structure which supports respective rotary drives for the support arms 44 and 46 at a fixed distance apart. The front face 26 of the grinding wheel lies in a plane perpendicular to the rotational axes of the support arms. It faces towards a workpiece carried by workpiece mount 48 in a direction parallel with the rotational axes of the support arms. The support arms 44 and 46 are moveable by respective drives so as to move the workpiece and the grinding wheel relative to each other. The workpiece follows a path in a plane perpendicular to the rotational axes of the support arms over the surface of the grinding wheel. In particular, a workpiece may be moved relative to the grinding wheel (at a constant speed for example) so that it follows a circular path along the groove, around the central axis of the grinding wheel.

Figure 7:
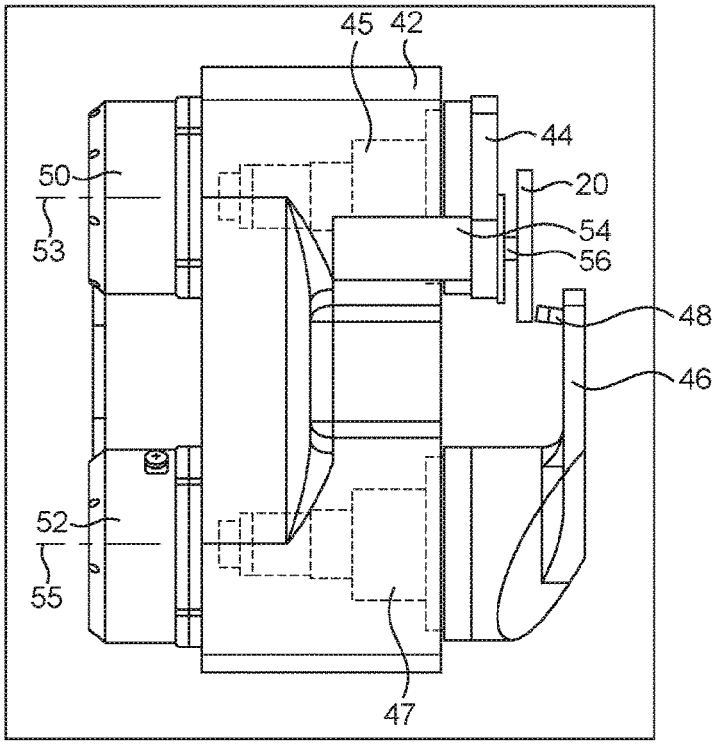
Figure 8:
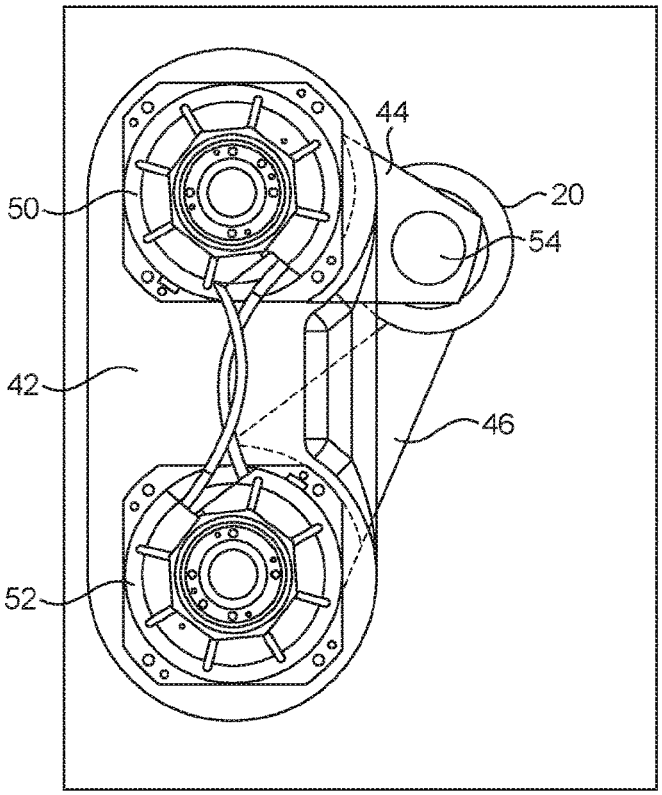
Figure 9:
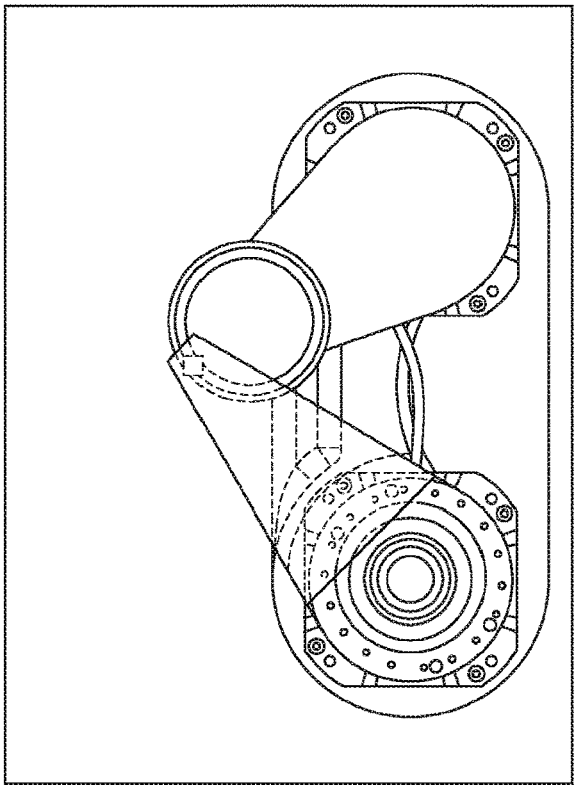
FIGS. 9 to 11 are plan views of the machine tool depicted in FIGS. 5 to 8 showing in FIGS. 5, 9, 10 and 11, successive stages in operation of the machine tool to move a workpiece round a circular path on a grinding wheel.
Figure 10:
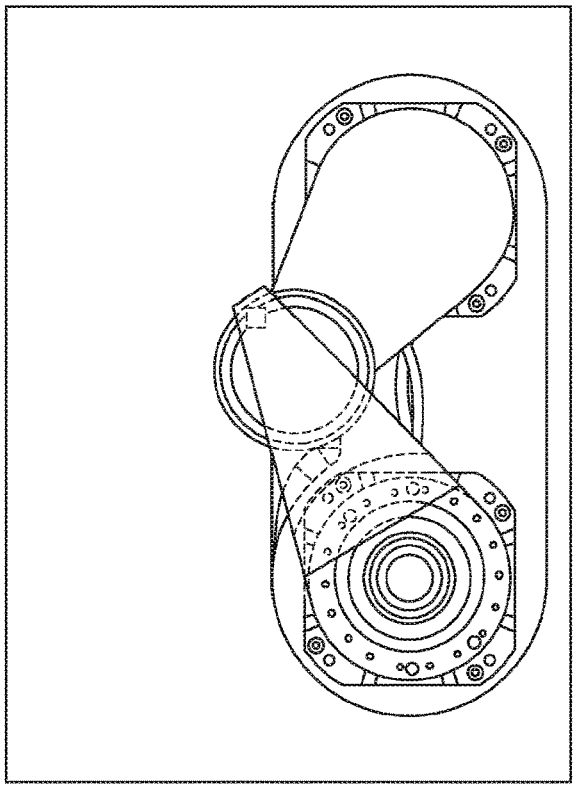
Figure 11:
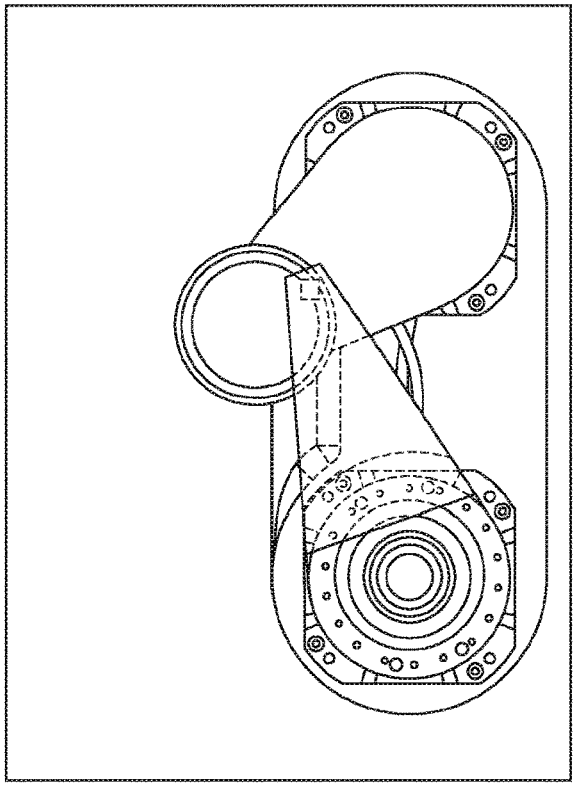
Figure 12:
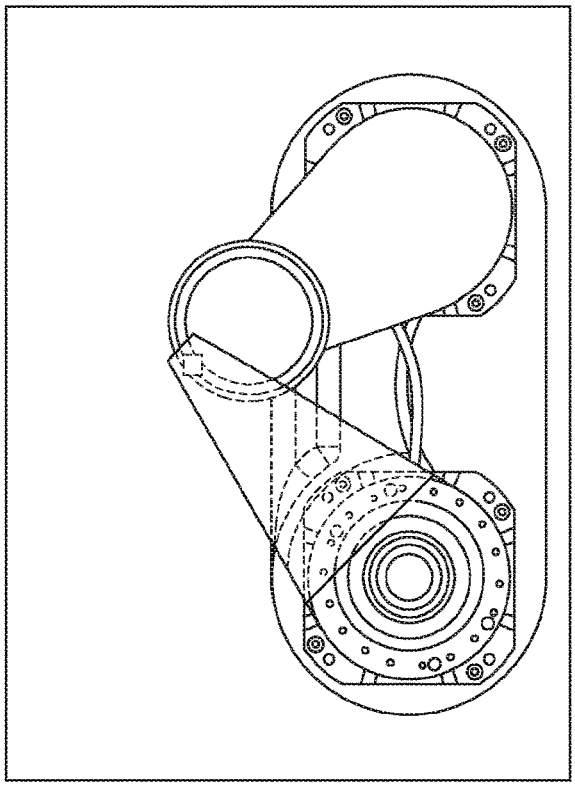
FIGS. 12 to 15 are plan views of an alternative machine tool embodying the invention in successive stages of its operation to move the workpiece round a circular path on a grinding wheel.
Figure 13:
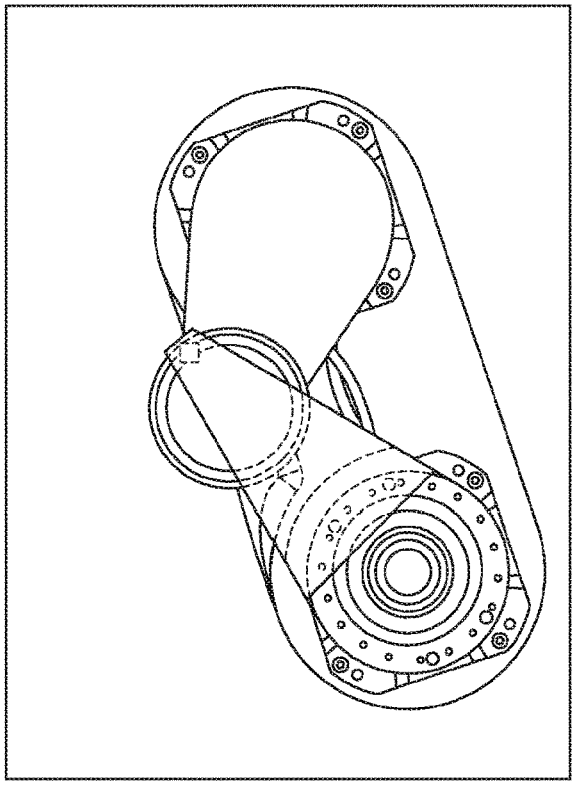
Figure 14:
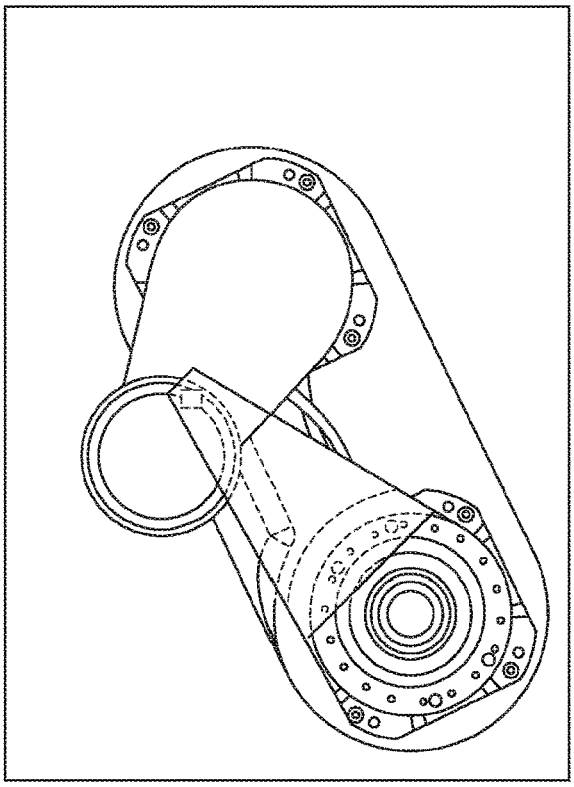
Figure 15:
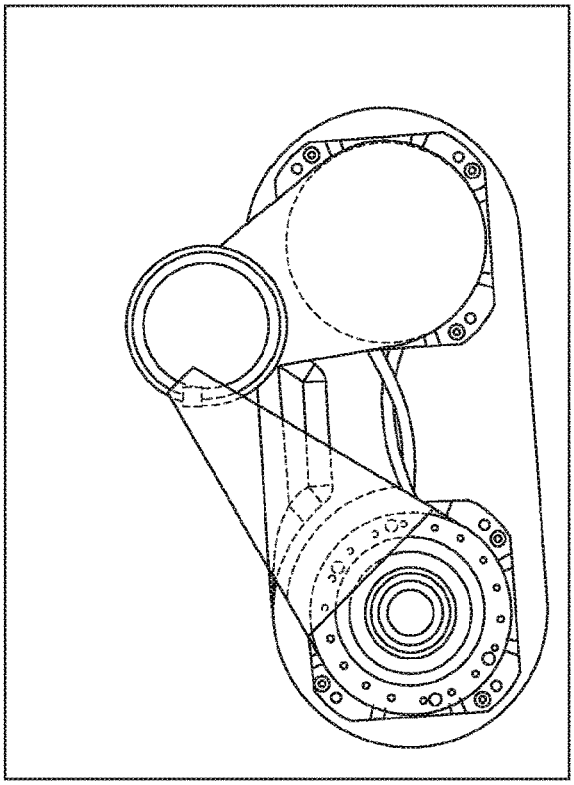

A plan view, a perspective view, a side view and a rear view of a machine tool having a configuration similar to that of the machine tool as shown in FIG. 4, are shown in FIGS. 5 to 8, respectively. In FIG. 7, the respective rotary drives 50 and 52 for the first and second support arms can be seen at the rear of the rigid structure 42. The drives are coupled to support arms 44 and 46 by respective drive shafts 45 and 47. The shafts 45 and 47 accommodate bearings, motor encoders and clamp components.

In FIG. 7, a grinding wheel spindle 54 can be seen which is carried by the first support arm on the opposite side thereof to the grinding wheel itself. Spindle 54 is operable to rotate the grinding wheel about its central axis 24. The grinding wheel is carried by and attached to the spindle by a tool mount 56.

FIGS. 5, 9, 10 and 11 show a sequence of stages in operation of the machine tool shown in these Figures to move the workpiece mount 48 around a circular path relative to the support arm 44, following the groove 30 formed in grinding wheel 20. This is achieved by the control arrangement of the machine tool by coordinating oscillating rotary motions of the two support arms.

In an embodiment shown, the first support arm carrying the grinding wheel is shorter than the second support arm carrying the workpiece. However, this may not necessarily be the case in other embodiments. The lengths of the arms may be selected as appropriate to suit the geometries of different circumstances and applications.

FIGS. 12 to 15 show successive stages in operation of a further machine tool implementation. This embodiment differs from that of FIGS. 5 to 11 in that, in operation of the machine, the second support arm 46 is held stationary whilst the rigid support 42 and first support arm 44 move relative thereto. From a comparison of these two sets of Figures, it is apparent that in FIGS. 5 to 11, the rigid support 42 is stationary, but in FIGS. 12 to 15, the rigid support 42 rotates back and forth whilst support arm 46 is stationary instead. This embodiment is capable of the same relative movements of the two arms and the rigid linking structure as that of FIGS. 5 to 11, and so it is able to move the workpiece around a circular path relative to the tool in the same manner. The workpiece is held in a stationary support, whilst the machine tool transports the depression in the face of the grinding wheel over the workpiece end following a circular path around the tool.

Figure 16:
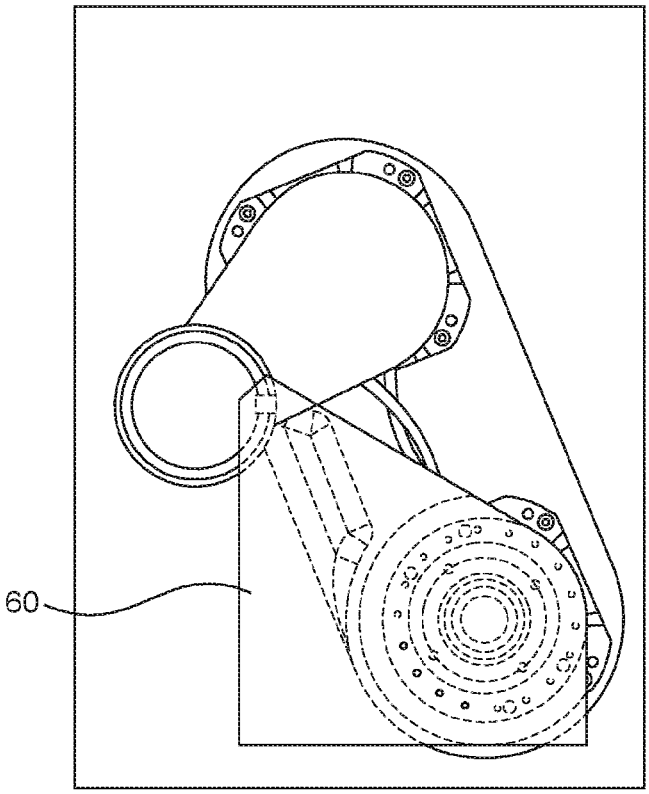
FIG. 16 is a plan view of a further machine tool embodying the invention having a stationary support arm for the workpiece.

FIG. 16 illustrates a modification of the machine tool shown in FIGS. 12 to 15. It includes a modified support structure 60 for the tool. Structure 60 is enlarged relative to the support arm 46 of the preceding embodiment to illustrate schematically that, since the tool support remains stationary, its support can be rigidly mounted in position in relation to a supporting base of the machine. This can enable the support for the workpiece to have a significantly stiffer construction.

Alternatively, the support for the tool may be fixed in position instead, and a workpiece (carried on arm 44) moved relative to it by rigid support 42 and support arm 44. This approach may be preferable in some circumstances as the workpiece is likely to be significantly lighter than the tool. Also, it may be preferable for the tool to be on a stationary support as it may need various additional services fed to it.

Figure 17:
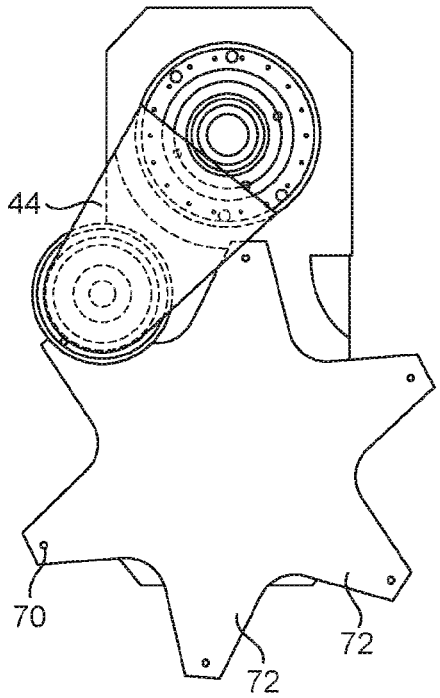
FIG. 17 is a plan view of another machine tool embodying the invention which includes multiple tool mounts.
Figure 18:
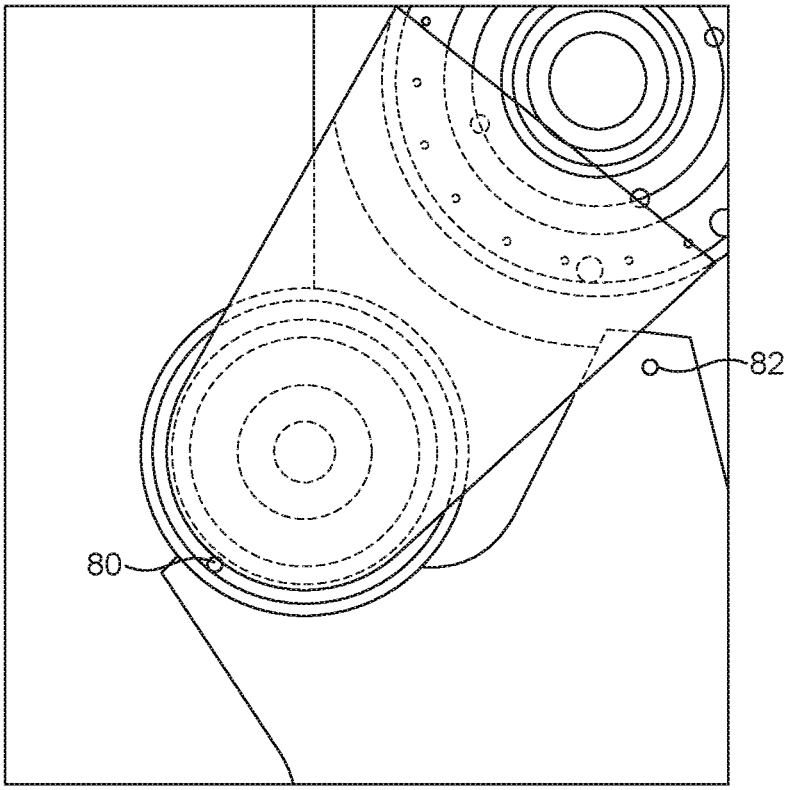
FIG. 18 is an enlarged view of part of FIG. 17.

FIGS. 17 and 18 illustrate a further variation of the machine tool. In this configuration, workpiece support arm 46 is replaced by a multiple workpiece support 70. In the embodiment shown in FIGS. 17 and 18, this support includes six limbs 72, each of which has a workpiece located towards its distal end. In the enlarged view of FIG. 18, a first workpiece 80 is in engagement with the grinding wheel 20 and a second workpiece has been loaded onto the adjacent limb of the support for shaping once processing of workpiece 80 has been completed. In this way, support 70 can be rotated to bring each of the workpieces carried thereon into engagement with the grinding wheel for processing. Accordingly, multiple workpieces can then be machined following a single machine set up procedure.

Relative rotation between components of the machine tools described herein may be achieved using rolling element bearings. Alternatively, hydrostatic or aerostatic bearings may be employed. Preferably, the support arms are mounted on hydrostatic bearings and aerostatic bearings are used in the tool spindle. Forming spindles may use aerostatic or rolling element bearings as appropriate. Where hydrostatic bearings are used, a higher viscosity of oil is preferably used in order to keep the associated hydrostatic system size to a minimum.

Preferably, a high resolution encoder is associated with each of the two support arms to ensure that their relative positions can be controlled with a high level of precision to shape and finish the surface of the workpiece.

In the machine tools depicted in the drawings, a rigid grinding wheel is shown mounted on the tool mount by way of example. It will be appreciated that the machine tool may be used in combination with other tools for movement by the machine tool relative to a workpiece mounted in the machine. In the case of machining an optic fibre ferrule, a tool providing a compliant abrasive surface may be used instead for example.

Figure 19:
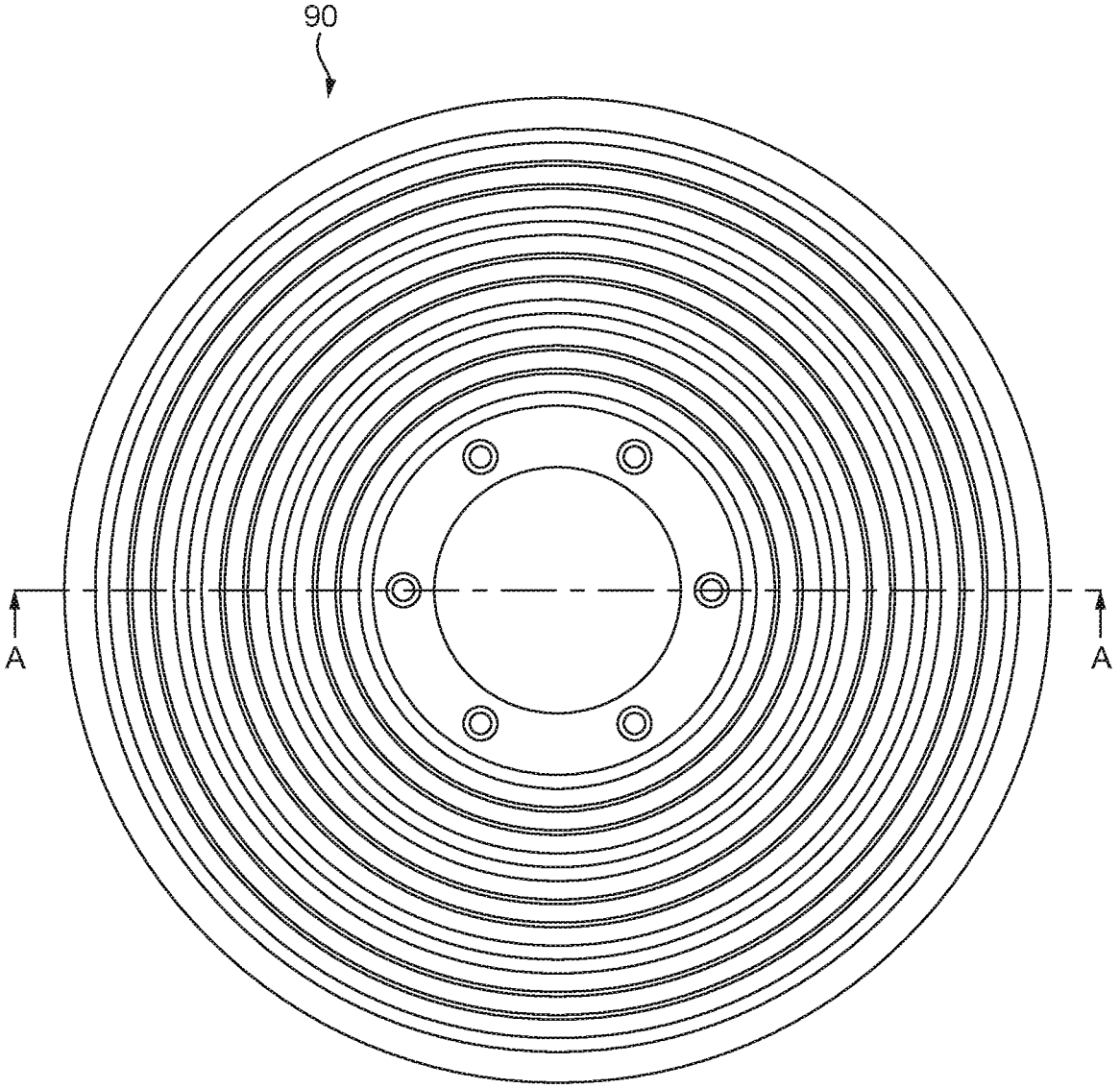
FIGS. 19 and 20 are plan and side views, respectively, of a grinding wheel having multiple grinding grooves according to an embodiment of the invention.
Figure 20:
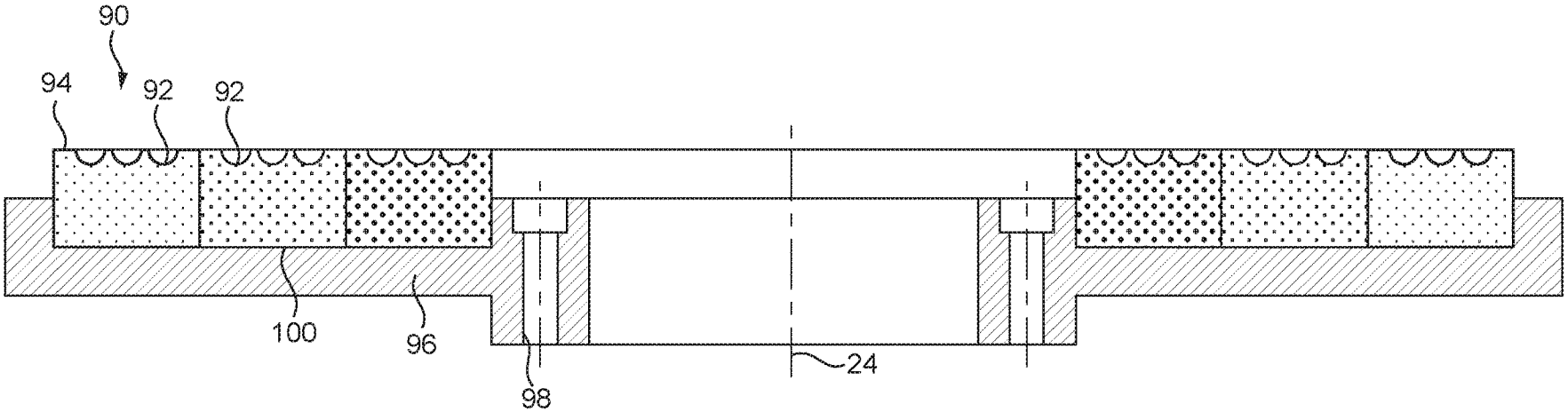

FIGS. 19 and 20 show plan and cross-sectional side views, respectively, of a grinding wheel according to an embodiment of the invention. FIG. 20 is a section along line A-A marked on FIG. 19.

The grinding wheel includes a plurality of concentric circular grooves 92 formed in a transverse side surface 94.

The grinding wheel comprises an integrally formed support body and hub member 96. A set of bolt holes 98 extends axially through the hub portion to enable the wheel to be fastened to a tool mount on a spindle.

The wheel has a number of sets of grooves, each having different grinding properties. A plurality (three in this example) of concentric abrasive sections are mounted on a supporting transverse surface 100 of the support body 96. Each section defines a set of concentric grooves (three in this example). Each section may include a different abrasive grit. For example, they may be constructed so as to be suitable for roughing, semi-finishing and polishing operations. One section may differ from another in terms of the size of the abrasive grain used, the bonding material and/or the density of each section. Each groove may have the same cross-sectional profile as the others in a transverse plane which includes the central axis of the wheel. Alternatively, different grooves may have different profiles. The profile of each groove in a plane containing the central axis of the wheel may substantially correspond to part of a circle (in one example, substantially semi-circular), or another generally curved or rounded profile, for example.

The provision of multiple grooves on the same wheel may reduce the frequency with which it is necessary to carry out a wheel conditioning cycle by increasing the total groove length presented by the wheel.

It will be appreciated that references herein to perpendicular or parallel relative orientations and the like are to be interpreted as defining substantially perpendicular or substantially parallel relationships between components within practical tolerances.

The invention claimed is:

1. A machine tool comprising:

first and second support arms;

a rigid structure which couples the first support arm to the second support arm;

a first rotary drive operable to rotate the first support arm and the rigid structure relative to each other about a first rotational reference axis;

a second rotary drive operable to rotate the second support arm and the rigid structure relative to each other about a second rotational reference axis, wherein the first and second rotational reference axes are parallel and spaced apart by an unadjustable fixed distance;

a tool mount carried by the first support arm at a location spaced from the first rotational axis, wherein the tool mount is rotatable relative to the first support arm about a tool reference axis which is parallel with the rotational reference axes and fixed in position relative to the first support arm;

a tool drive for rotating the tool mount about the tool reference axis;

a workpiece mount carried by the second support arm at a location spaced from the second rotational axis; and a control arrangement configured to control the first and second rotary drives such that the workpiece mount follows a predetermined path relative to the tool mount in a plane perpendicular to the rotational reference axes.

2. The machine tool of claim 1, wherein the control arrangement is configured to control the first and second rotary drives such that the workpiece mount follows a circular path relative to the first support arm in a plane perpendicular to the rotational reference axes.

3. The machine tool of claim 1, wherein one of the support arms is fixed in position relative to a supporting base of the machine tool.

4. The machine tool of claim 1, wherein the rigid structure is fixed in position relative to a supporting base of the machine tool.

5. The machine tool of claim 1, wherein the first and second rotary drives are the only drives of the machine tool which are operable to move the tool mount and the workpiece mount relative to each other in a plane perpendicular to the first and second rotational reference axes.

6. The machine tool of claim 1, wherein the workpiece mount is arranged to hold a workpiece in a fixed position rotationally with respect to the second support arm during machining of the workpiece.

7. The machine tool of claim 1, wherein at least one of the tool mount and the workpiece mount is moveable relative to the rigid structure in a direction parallel to the first and second rotational reference axes.

8. The machine tool of claim 1, wherein the second support arm forms part of a workpiece support which carries a plurality of workpiece mounts, each of which is spaced from the second rotational axis.

9. The machine tool of claim 1, wherein the tool mount is arranged to carry a grinding wheel with its central axis coaxial with the tool reference axis.

10. The machine tool of claim 1, wherein the workpiece mount is arranged to carry a fibre optic ferrule.

11. The machine tool of claim 2, including a tool mounted on the tool mount which includes a surface in the plane perpendicular to the rotational reference axes for engagement with a workpiece held in the workpiece mount.

12. The machine tool of claim 9, further comprising the grinding wheel, wherein the grinding wheel comprises a wheel body having a central rotational axis about which the grinding wheel is rotated in use, and a transverse side surface, wherein the transverse side surface includes at least one circular groove for grinding a workpiece, the groove having a central axis which is coaxial with the central rotational axis of the grinding wheel.

13. The machine tool of claim 12, wherein the transverse side surface includes at least two concentric circular grooves.

14. The machine tool of claim 13, wherein two of the grooves have different abrasive properties.

15. The machine tool of claim 14, wherein one of the two grooves has a larger diameter than the other and has a coarser grit than the other.

16. The machine tool of claim 14, wherein the abrasive properties of the two grooves are selected from roughing, semi-finishing and polishing.

17. The machine tool of claim 13, wherein two of the grooves have different profiles in a cross-sectional plane parallel to and including the central rotational axis of the grinding wheel.

18. The machine tool of claim 1, further comprising a grinding wheel carried by the tool mount, wherein the grinding wheel comprises a wheel body having a central rotational axis about which the wheel is rotated in use, and a transverse side surface, wherein the transverse side surface includes at least one circular groove for grinding a workpiece, the groove having a central axis which is coaxial with the central rotational axis of the wheel.

19. A method of machining a workpiece using the machine tool of claim 1, comprising the steps of:

mounting a workpiece in the workpiece mount;

engaging the workpiece with a tool mounted on the tool mount; and rotating the first support arm and the rigid structure relative to each other about the first rotational reference axis and rotating the second support arm and the rigid structure relative to each other about the second rotational reference axis such that the workpiece follows a predetermined path relative to the tool in a plane perpendicular to the rotational reference axes.

20. The method of claim 19, wherein, in the rotating step, the workpiece follows a circular path relative to the tool in a plane perpendicular to the rotational reference axes.

21. The method of claim 20, wherein the workpiece is engaged in the engaging step with a first groove on the tool which lies on the circular path, and the method includes the further steps of:

disengaging the workpiece from the first groove;

engaging the workpiece with a second groove on the tool which is concentric with the first groove; and rotating the first support arm and the rigid structure relative to each other about the first rotational reference axis and rotating the second support arm and the rigid structure relative to each other about the second rotational reference axis such that the workpiece follows the second groove.

22. The method of claim 19, wherein the workpiece is a fibre optic ferrule.

23. The method of claim 19, wherein the workpiece is fixed in position rotationally with respect to the second support arm.

* * * * *